United States Patent [19]

Yacoboni

[11] Patent Number: 4,784,172

[45] Date of Patent: Nov. 15, 1988

[54] INSTANT EMERGENCY SHELTER

[76] Inventor: Joseph D. Yacoboni, P.O. Box 1606, Lake Placid, Fla. 33852

[21] Appl. No.: 66,326

[22] Filed: Jun. 25, 1987

[51] Int. Cl.[4] ..... E04H 15/00; E04H 15/02; E04H 15/18; E04B 1/32

[52] U.S. Cl. ..... 135/87; 52/80; 52/82; 135/904; 135/97; 135/102

[58] Field of Search ..... 135/87, 97, 102, 904; 52/80, 82, 86, 90

[56] References Cited

U.S. PATENT DOCUMENTS

| | | | |
|---|---|---|---|
| 3,316,682 | 5/1967 | Natalis | 52/245 X |
| 3,763,608 | 10/1973 | Chamlee | 52/80 |
| 3,894,367 | 7/1975 | Yacaboni | 52/80 |
| 4,133,150 | 1/1979 | Yacaboni | 52/82 X |
| 4,663,898 | 5/1987 | Yacaboni | 52/80 X |

FOREIGN PATENT DOCUMENTS

| | | | |
|---|---|---|---|
| 938073 | 12/1973 | Canada | 52/82 |
| 1094439 | 12/1960 | Fed. Rep. of Germany | 52/82 |
| 529523 | 8/1957 | Italy | 52/82 |

*Primary Examiner*—J. Karl Bell

*Attorney, Agent, or Firm*—George B. Oujevolk

[57] ABSTRACT

A dome-shaped shelter of a plurality of water-proof foldable light-weight panels. Each panel is of three sections, trapezoidal base and middle sections and a truncated triangular top section with a transverse seam joining the sections. Each foldable panel has lateral flanges on each side. The flange along one side is flat and vertical while the flange on the other side is of an inverted U-shape, so that it can loop over the flat vertical flange on the adjacent panel and a sping clip holding the flanges together. Apertures in the panels form doors or windows therein.

3 Claims, 5 Drawing Sheets

FIG. 3
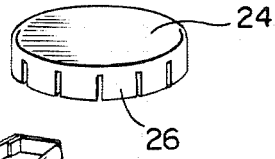
FIG. 8
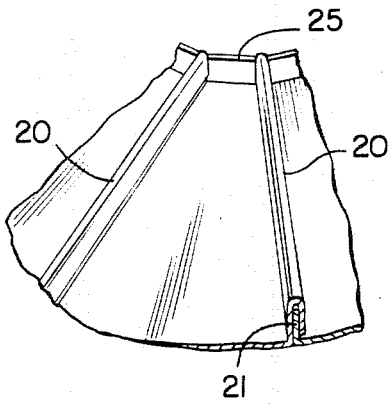
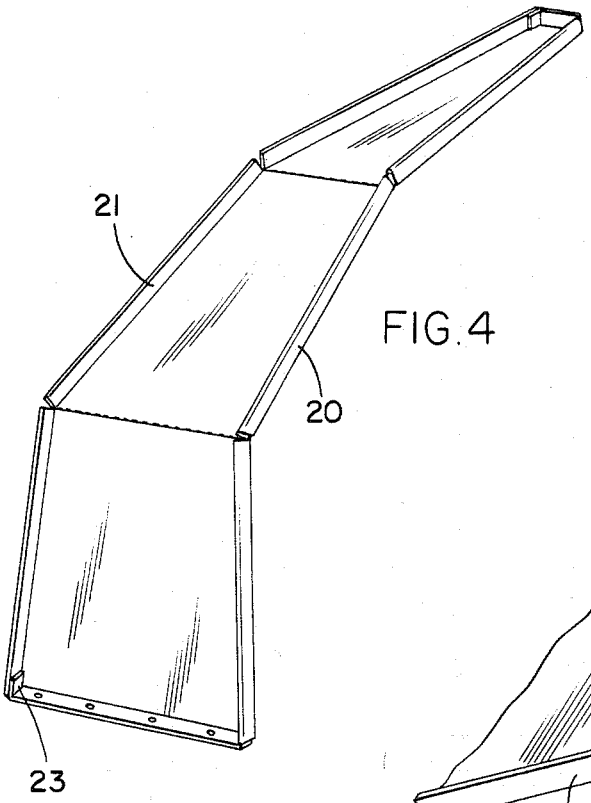
FIG. 4
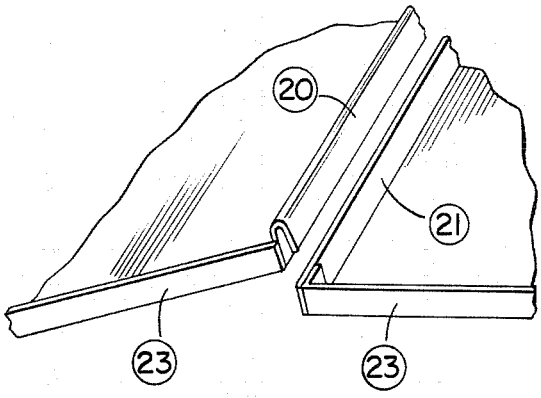
FIG. 7
FIG. 6A
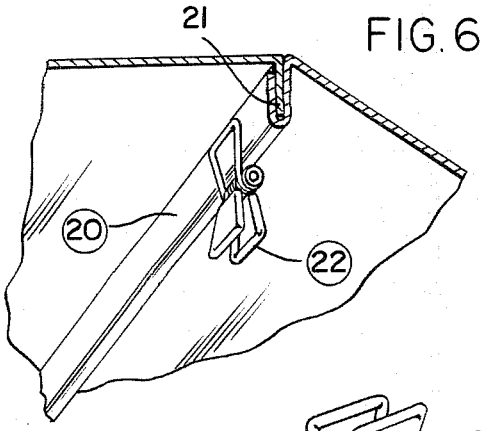
FIG. 6
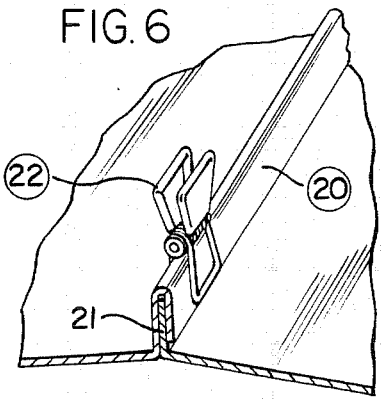
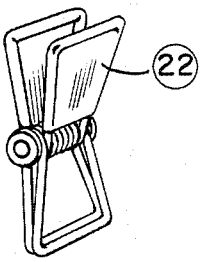
FIG. 5
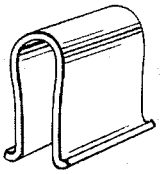
FIG. 5A

INSTANT EMERGENCY SHELTER

BACKGROUND OF THE INVENTION

The present invention relates to an instant emergency shelter, and more particularly to a shelter which a person can carry on the back and which can be readily assembled for instant use.

SUMMARY OF THE INVENTION

Thus, it is an object of the invention to provide a dome-shaped structure which is to be used for a shelter. The structure is made up of a plurality of water-proof foldable light-weight panels. Each panel has an almost rectangular but actually trapezoidal base section, a trapezoidal middle section, with an almost triangular top trapezoidal section. The base section and the middle section are joined by a transverse seam while the middle section and the top section are likewise joined by a transverse seam. The top sections of each panel is coupled to a central coupling ring, preferably having a ring cover.

Another object of the present invention is to provide lateral flanges on each panel disposed to stand vertically when the structure is assembled. Thus, the panels are aligned one alongside the other so that the lateral flanges are side by side. However, in each foldable panel, the vertical flange on one side is flat while the flange on the other side has an inverted U-shaped cross-section so that it can loop over the flat vertical flange on the adjacent panel.

A further object of the present invention is to provide an arrangement for holding the flanges together using spring-loaded clips, advantageously with a butterfly grip. Also, one of the panels may have a door-like aperture defined therein or one or more openable windows can be provided in the shelter. An elogational panel can also be provided.

A still further object of the invention is to provide a structure which can be readily assembled and dissassembled and carried on a person's back.

The invention as well as other objects and advantages thereof will be more apparent from the following detailed description when taken together with the accompanying drawings, in which:

BRIEF DESCRIPTION OF THE DRAWINGS

FIG. 3 depicts the coupling ring with a top in a perspective view;

FIG. 4 illustrates how one of the foldable panels is affixed to a coupling ring, it is to be noted in this perspective view that the foldable flanges are now in the vertical plane;

FIG. 5 is a perspective view of one of the spring-loaded clips with its butterfly grip;

FIG. 5A explains in a perspective view how another type of clip can also be used;

FIG. 6 illustrates the use of the spring-loaded clip when affixed to one of the foldable panel edges;

FIG. 6A is a perspective upside-down view of FIG. 6;

FIG. 7 shows how the panel flange with the inverted U-shaped cross-section is affixed to the flange in the adjacent panel;

FIG. 8 illustrates how the panels can be attached to the coupling ring;

DETAILED DESCRIPTION

Figure 1:
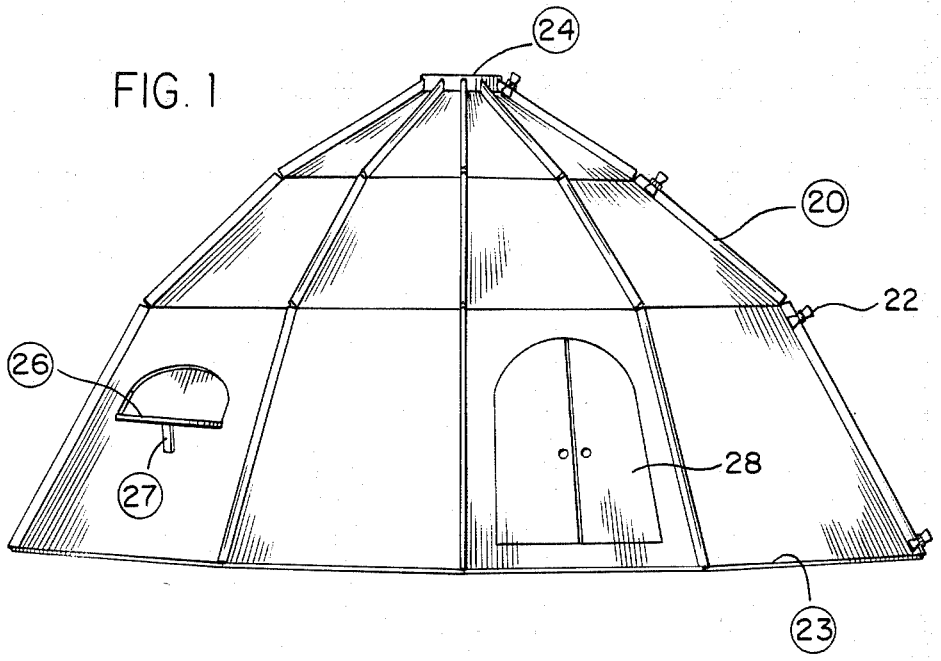
FIG. 1 presents a completed and assembled structure ready for use as a shelter, in a perspective view.
Figure 2:
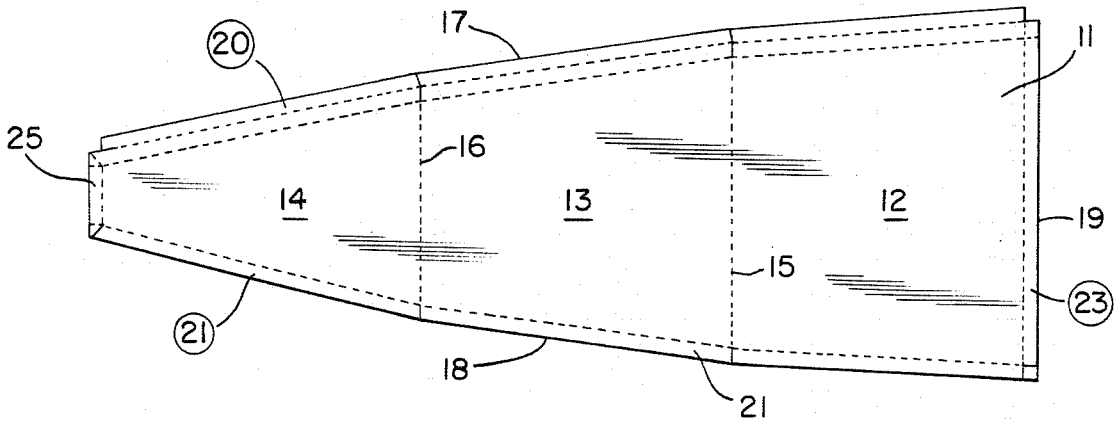
FIG. 2 is one of the foldable panels as seen from the top.
Figure 2A:
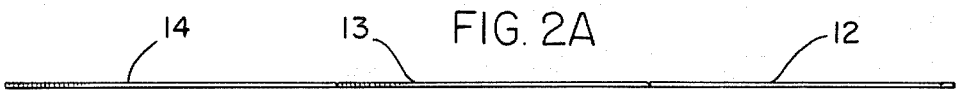
FIG. 2A shows the foldable panel of FIG. 2 when seen from the side and before assembled, it is to be noted that the foldable edges are in the same plane as the panel.
Figure 9:
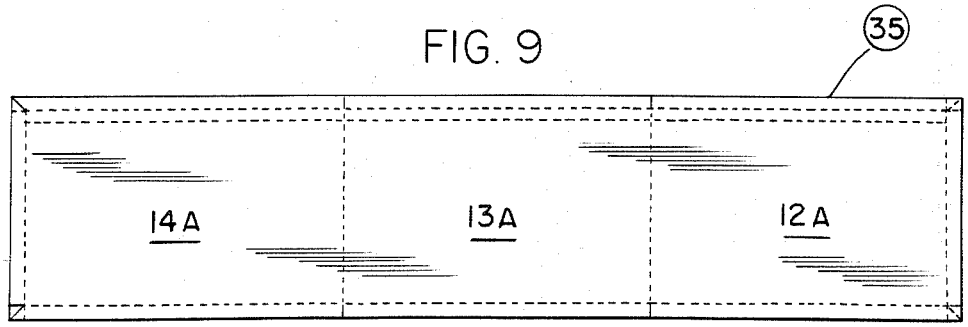
FIG. 9 is a top view of an elongation panel.
Figure 9A:
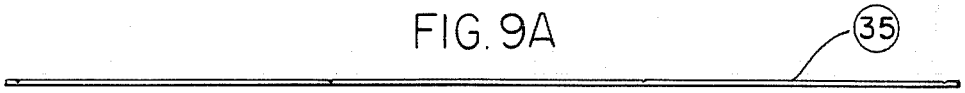
FIG. 9A is a side view of the elongation panel shown in FIG. 9.
Figure 10:
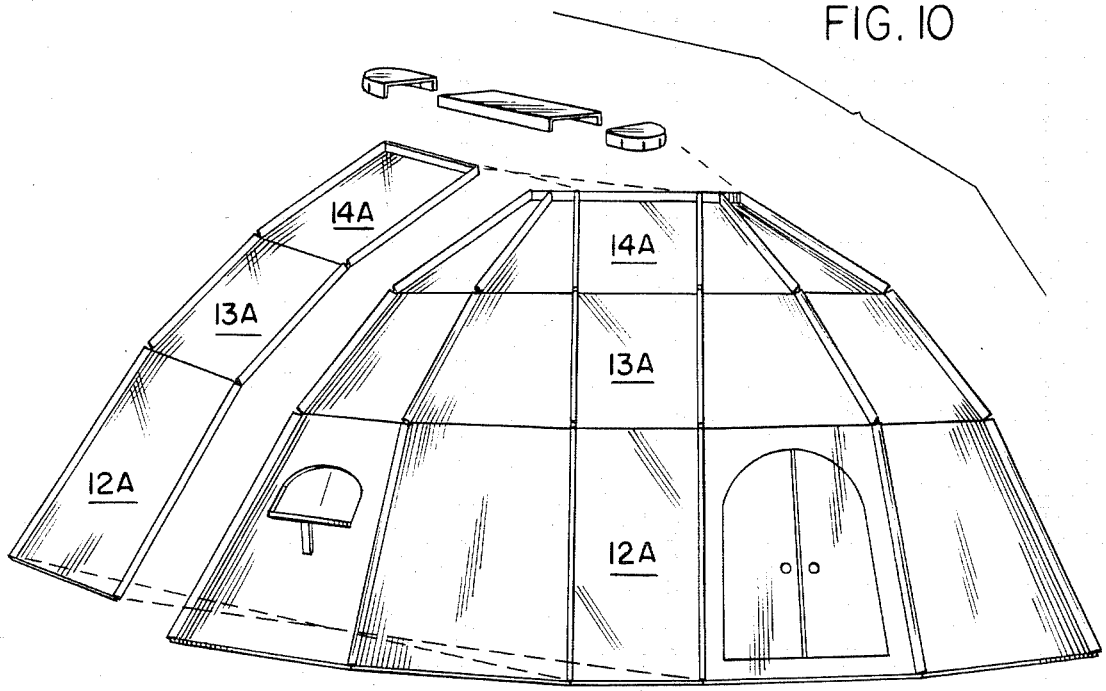
FIG. 10 illustrates the use of the elongation panel to lengthen the shelter contemplated herein.
Figure 11:
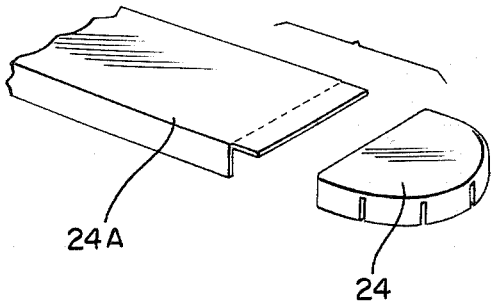
FIG. 11 shows how the coupling ring is split to accomodate the elongation panel; and, FIG. 12 is an illustration of a person carrying the shelter on the back.
Figure 12:
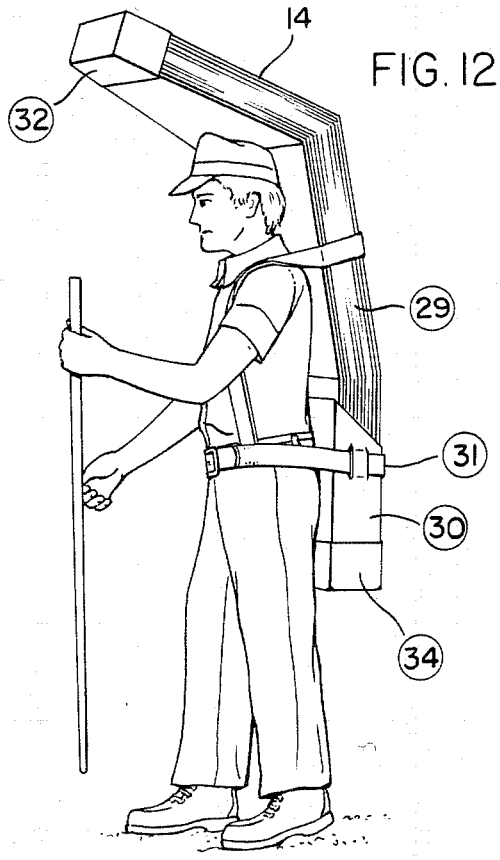

Shown in the drawings is a shelter (FIG. 1) which will be built mostly from the panels shown in FIG. 2. The panels 11 have three sections: a base section 12 which is substantially rectangular in shape, although it is really trapezoidal; a trapezoidal middle section 13, and an almost triangular top section 14. These sections are foldably connected at the inner transverse seams 15 and 16 and will be connected to other components at the outer edges 17, 18, 19.

The panels are connected to each other along their lateral edges. One lateral edge 17 will have a flange with an inverted U-shaped cross section 20, while the other edge 18 will have a vertical flange 21 adapted and disposed to receive the U-shaped cross-sectional flange 20.

As shown in the drawings, the vertical flange 21 is held to the inverted U-shaped flange 20 by a butterfly clip 22. But, other types of clips may also be suitable. At the bottom of the base section 12, the lower edge 19 has a horizontal flange 23 (see FIGS. 3 and 3). Connected to the apex of the top section 14 is a ring 24 with a cover.. The apex of the top section also has a vertical flange 25 which is used to couple the panel to the ring 24.

One of the panels may have a window 26 with a support 27 to hold the window. Actually, the window is a semi-circle cut out of the panel. Another panel may also have a door-like aperture 28. Needless to say, the panels are all water-proof and may be made of cardboard of plastic.

It is also possible to erect an elongated structure. Together with the trapezoidal panels, an elongated panel 35 provided. This is a rectangular panel with three sections 12A, 13A, 14A, corresponding to the three sections in the trapezoidal panel, and, like the trapezoidal panels, the rectangular panel will have a vertical flange 21A and a U-shaped cross-sectional flange 22A, one on each side of the panel. This rectangular panel is joined to the trapezoidal panels in the same way as two trapezoidal panels are joined. However, the coupling ring 24 is split in two and a rectangular section 24A is interposed between the two split halves.

As shown in the drawings, the panels can be placed one over the other to form a bundle 29, and held in a light-weight container 30 or a box. Support belts 31 can be provided to carry the bundle so that the belts fit around the waist of the person carrying the bundle. Top snaps 32 are provided on the container to hold all the sections. The top panel section 14 can fold over the head of the person carrying the bundle to keep off elements of the weather. Additionally, there is an other carrying case 35 of the box type to allow for the storage of anchor pins and clips. This additional carrying case can be fitted below the container 30. Then, if an elongation panel is used, it can also be fitted to the bundle.

It is to be observed therefore, that the present invention provides for a plurality of foldable panels, each panel having at least three sections, 12, 13, 14. The sections are of trapezoidal shape although the base section can be almost a rectangle while the top section is almost a triangle. Also, the panels have side edges 17 and 18 as well as a bottom edge 19. One of the side or lateral edges 18 has a vertical flange 21 while the other edge 17 has a flange with a U-shaped cross section 20 which will fit over the vertical flange 21. These foldable panels can be placed one over the other or can be shipped flat, or bent so as to be carried over a person's back. In assembling the shelter, the panels are assembled as shown in FIG. 1. The individual panels are trapezoidal in shape with the base panel being almost rectangular whereas the top panel 14 is almost triangular. The top panel has a vertical flange 25 which can be attached to a ring 24 acting as the locus of all the panels. The base panel 12 has a lower edge 19 with a horizontal flange 23 which can be used to pin the structure to the ground. The lateral flanges 20, 21 are held together by clips 22, preferably of the butterfly type. In carrying the disassembled structure, a container 30 is used with an open box-like bottom or a separate section 34 to hold the clips 22 and pins needed to assemble the shelter and fasten it to the ground. Top snap means 32 also are provided to hold the apex of all the top panel sections. Belts 31 can be used to hold the structure when disassembled so a person can carry it on the back. To elongate the shelter, flat three-sectional panels can be used with a split ring and a rectangular piece between the ring split sections.

Finally, it is to be observed that the ring 24 has around its periphery a plurality of teeth-like tabs 26 designed to fit over the top vertical tab 25 at the apex of the top section. These tabs are so sized and so separated that they fit over the top flange 25 and over the two lateral flanges 20, 21 and are held thereto by their resiliency. The ring naturally has a cover to keep out the elements. The cover is preferably at least partly removable so as to permit the use of a stove or heater with a chimney if needed.

What is claimed is:

1. A shelter, comprising in combination:

(a) a plurality of trapezoidal panels divided in at least three trapezoidal sections and comprising a base section (12), almost rectangular in shape with the wider part of the section being at the bottom, a trapezoidal middle section (13), and an almost triangular top section (14), said sections being along defined transverse seams;

(b) a ring (24) acting as the locus of the top sections (14) of all the trapezoidal panels, said top sections having a top flange (25) adapted to be coupled to said ring, said ring being divided into resilient teeth-like tabs (26) corresponding in number to said panels, said tabs (26) being adapted and designed to engage said top flange (25) so as to hold the panels;

(c) first and second lateral vertical flanges (20, 21) on said panels, the first flange (20) having a U-shaped cross-section, while the second flange (21) has a straight vertical shape, designed to enter the U-shape and be held therein;

(d) clips (22) designed to fit over the U-shape of the first flanges (20) to firmly hold the first and second flanges together;

(e) a horizontal bottom flange (23) at the lower end of the base panel section (12) to be used in pinning the shelter to the ground;

(f) a door-like opening defined in at least one of said panels; and, (g) a window-like opening defined in at least one of side panels.

2. A shelter as claimed in claim 1 including a split ring wherein the split halves of the ring are separated by a flat rectangular piece, and flat panels are held to the sides of said flat rectangular piece, said flat panels being coupled to adjacent trapezoidal panels by similar flanges.

3. A plurality of individual unassembled panels as described in claim 2, which when assembled will form a shelter.

* * * * *